United States Patent [19]

Stegmann et al.

[11] Patent Number: 4,685,310

[45] Date of Patent: Aug. 11, 1987

[54] MULTI-PURPOSE VALVE ASSEMBLY

[75] Inventors: Rudolph Stegmann, Gettysburg; Zoltan A. Mandy, Waynesboro, both of Pa.

[73] Assignee: Frick Company, Waynesboro, Pa.

[21] Appl. No.: 918,063

[22] Filed: Oct. 14, 1986

[51] Int. Cl.[4] ..... F25B 41/04

[52] U.S. Cl. ..... 62/217; 137/614.2; 137/614.21; 62/510

[58] Field of Search ..... 137/614.2, 614.21, 549; 62/217, 498, 510

[56] References Cited

U.S. PATENT DOCUMENTS

| | | | |
|---|---|---|---|
| 2,069,808 | 2/1937 | Andersson | 137/505.41 |
| 2,105,876 | 1/1938 | Birch | 137/505.41 |
| 2,225,838 | 12/1940 | Miller | 137/614.2 |
| 2,661,893 | 12/1953 | Le Valley | 417/295 |
| 3,485,371 | 12/1969 | Costantini | 137/614.2 |
| 3,744,751 | 7/1973 | Robinson | 251/276 |
| 3,788,776 | 1/1974 | Post et al. | 417/295 |
| 4,227,380 | 10/1980 | Laucks et al. | 62/217 |
| 4,406,588 | 9/1983 | Hofmann | 417/295 |
| 4,473,093 | 9/1984 | Hart | 137/522 |

FOREIGN PATENT DOCUMENTS

| | | | |
|---|---|---|---|
| 177638 | 12/1961 | Sweden | 137/614.21 |

*Primary Examiner*—A. Michael Chambers
*Attorney, Agent, or Firm*—Dowell & Dowell

[57] ABSTRACT

A flow control valve in a unitary casing has a seat for a manual stem valve on one side of the valve opening and a seat for a check valve on the other side, the check valve being lightly urged toward closing position against differential pressure in the flow stream and being receptive to external pressure control.

8 Claims, 1 Drawing Figure

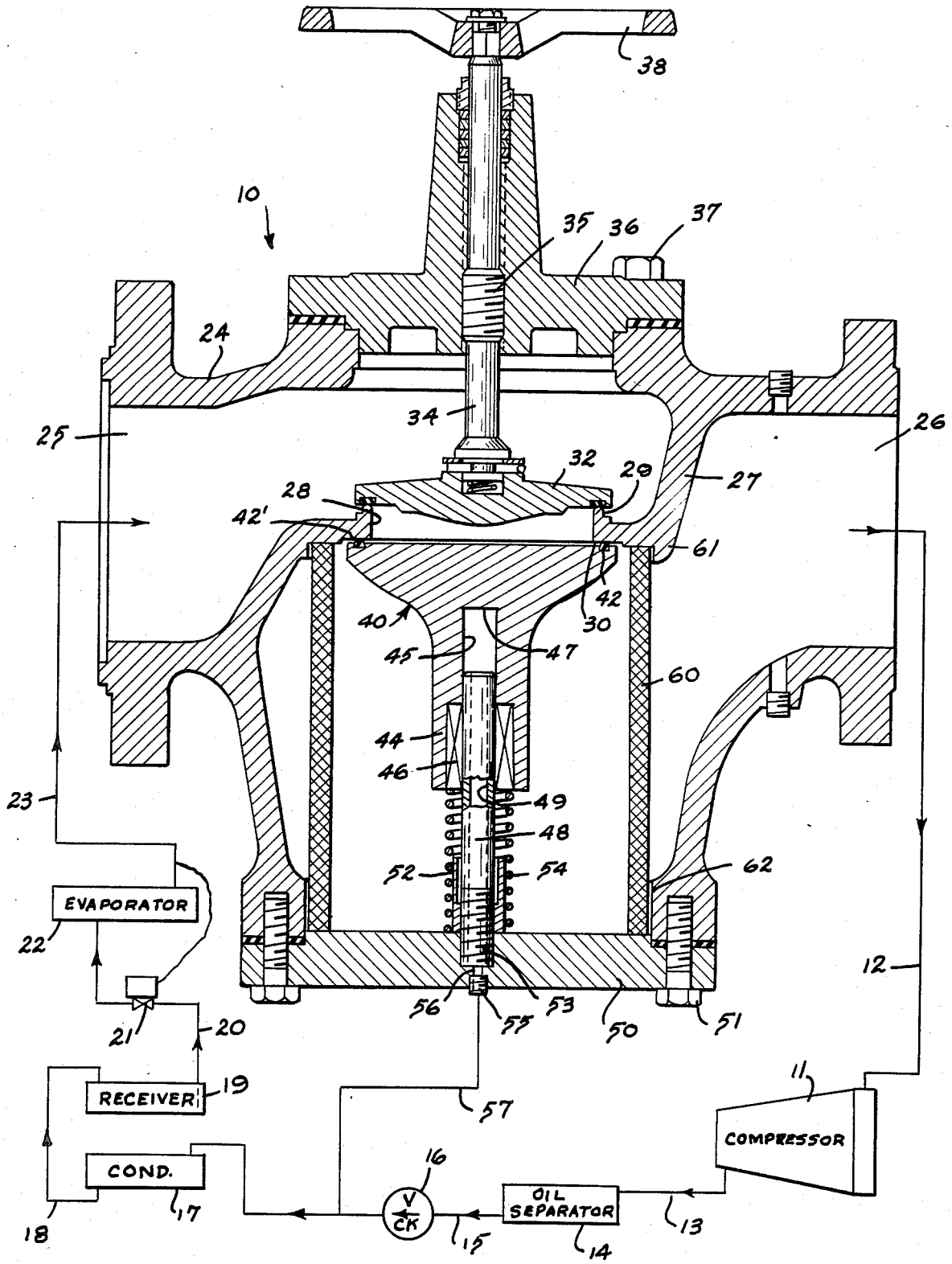
10
38
35
36
37
24
34
25
26
32
29
27
28
42'
61
42
30
40
45
47
60
44
46
49
48
23
52
54
62
EVAPORATOR
22
12
56
55
53
50
51
21
20
RECEIVER
19
57
11
COMPRESSOR
COND.
16
V
CK
OIL SEPARATOR
13
18
17
15
14

MULTI-PURPOSE VALVE ASSEMBLY

BACKGROUND OF THE INVENTION

1. Field of the Invention

This invention relates to flow control valves and more particularly to a valve used in the inlet or suction line of a compressor between the evaporator and the compressor of a refrigeration system.

2. Description of the Prior Art

Flow control valves, including check valves, are commonly used in refrigerant lines where pressure reversals can cause undesirable reverse flow. A check valve may be opened by a portion of the pressure drop which causes flow in the line. Various types of check valves are known, such as those which close only when flow exceeds a maximum desired rate, electrically operated, which require no pressure drop to remain open, and remote pressure operated which are subject to a higher pressure source of refrigerant.

The Andersson U.S. Pat. No. 2,069,808 discloses a downstream controlled pressure regulator in which the valve stem is centered by a diaphram and having a filter in the inlet portion of the valve.

The Birch U.S. Pat. No. 2,105,876 discloses a downstream water pressure regulator having a cylindrical screen mounted between an interior wall and the removable cap in the inlet side of the regulator.

The Le Valley U.S. Pat. No. 2,661,893 discloses a control valve operated by external pressure in response to variations in discharge pressure.

The Robinson U.S. Pat. No. 3,744,751 discloses a check valve whose length of travel is controlled by a manual valve.

The Post et al. U.S. Pat. No. 3,788,776 discloses in FIG. 2 an inlet throttling valve which is closed in response to pressure in line 68 and in which the spring 56 assists in opening the valve.

The Hoffman U.S. Pat. No. 4,406,588 discloses a suction regulator for a compressor in which full opening of the valve is dependent on discharge pressure from the compressor.

The Laucks et al. U.S. Pat. No. 4,227,380 discloses a combination valve for the inlet of a compressor including a manually operable valve, an automatically controlled stop valve, an automatically controlled check valve, and a strainer on the inlet side of the valve.

The Hart U.S. Pat. No. 4,473,093 discloses a fluid control valve which is operated in response to an external "control" gas pressure.

SUMMARY OF THE INVENTION

It is an object of the invention to provide in a single housing a manually operable valve and an independently operable check valve.

A further object of the invention is to provide a manually operable valve and a check valve in which the check valve may be subjected to pressures from external sources to control its operation.

A further object of the invention is to provide in a valve structure a check valve of relatively simple structure and of such construction that an external source of pressure may be connected thereto to enable the use of a high pressure vapor to add to the seating pressure or to cause throttling of the vapor flow, or complete shut-off.

It is a further object of the invention to provide a multi-purpose valve including a check valve in which a vapor strainer is accomodated on the outlet side of the valve and which is easily removable and replaceable.

BRIEF DESCRIPTION OF THE DRAWING

The embodiment of the invention is illustrated in the accompanying drawing which illustrates a section through a valve in accordance with the present invention, and schematically indicating how it may be connected in a conventional refrigeration system.

DESCRIPTION OF THE PREFERRED EMBODIMENT

With further reference to the drawing the valve 10 of the present invention is disclosed in use with a conventional refrigeration system including a rotary screw compressor 11, having an inlet or suction line 12 connected to the valve and an outlet line 13 for discharging compressed refrigerant through an oil separator 14 to a line 15 having a check valve 16 which leads to a condenser 17. Condenser 17 is connected by line 18 to a receiver 19 which is connected by line 20 having an expansion valve 21 to an evaporator 22 having a discharge line 23 connected to the inlet of the valve 10.

The valve 10 includes a housing 24 having a flanged inlet chamber 25 and an oppositely disposed flanged outlet chamber 26. Intermediate the inlet and outlet chambers, the central portion of the valve has an interior wall 27 with an opening 28.

The wall 27 has an upper seat 29 and a lower seat 30 contiguous to the valve opening 28.

Positioned within the inlet chamber 25 and just above the opening 28 is a valve member or button 32 which is rotatably connected by conventional means to a valve stem 34 having a threaded portion 35 that is received within a cover member or bonnet 36 that is connected to the housing by suitable fastening means 37. At its other end the stem is provided with a handwheel 38. Rotation of the handwheel is operative to move the button 32 into and out of engagement with the upper seat 29.

Beneath the valve opening 28 a sliding button or valve 40 is positioned within the outlet chamber 26. A button 40 having a groove 42 with seating ring 42' which engages the lower seat of the valve opening 28. In order to reduce possible chatter noise at part load compressor operations, the ring 42' is preferably of a resilient and non-metallic material. The lower portion of the sliding button has a shank portion 44 having an internal wall or bore 45 with ball bushing 46 and an internal end portion 47.

The internal wall 45 slidingly receives a shaft 48 having a central bore 49, the lower end of the shaft being rigidly mounted in end or cover plate 50 which is connected by fasteners 51 to form the lower portion of the housing 10. The shaft 48 is preferably threaded into the cover plate 50 and is locked in place by a spacer 52 having a threaded portion 53 and which serves as a lock nut for the shaft. The spacer is also a guide for a spring 54 and extends to the required height to act as a stop for the sliding button 40. The spring engages the cover plate 50 at one end and the lower end of the shank portion 44 of the button 40 at the other end and lightly urges the button into seating engagement.

A fitting 55 is provided in the lower portion of the cover plate 50, in communication with a bore 56 communicating with the bore 49 of the shaft, for a pipeline 57 which may be connected for example to the line 15 from the compressor downstream of the check valve 16.

Mounted beneath the portion of the interior wall 27 which defines the valve opening 28 is a cylindrical strainer 60 which is received at its upper end within the shoulder portion 61 and at its lower end by the guide portion 62 of the housing. The strainer can be easily removed for inspection and replacement by the removal of the cover plate 50.

During normal operation of the compressor the handwheel 38 is operated to move the button 32 out of engagement with its seat so as to permit free flow through the upper portion of the valve. During start-up of the compressor, the action of the spring 54 tending to close the button 40 is supplemented by the pressure through the line 57 acting against the end wall 47 of the button 40. This is sufficient during start-up to keep the valve closed in order to reduce the load on the compressor. However, as the compressor passes the start-up condition, the differential pressure operating against the button 40 is sufficient to open the valve against the combined pressure of the spring and the vapor pressure against the wall 47, since the area 47 against which the pressure is applied is relatively small in comparison with the area of the upper portion of the bowl against which the differential pressure is applied.

When the compressor is shut down, for a limited time, the pressure in the line 57 acting against the area 47 only gradually decreases due to the temperature prevailing in the condenser 17, and therefore is sufficient to hold the check valve 40 firmly closed. In the case of an extended shut-down, the handwheel 38 is operated to close the button 32 against the seat 29.

Obviously the pressure applied within the hollow shaft 48 to the area 47 may be taken from some source other than that which is illustrated in the drawing, in order to add to the seating pressure or to cause throttling or complete shut-off of the valve 40.

We claim:

1. A flow control valve for use in the suction line to a compressor of a vapor refrigeration system having a compressor discharge line to a condenser and an evaporator, comprising a valve housing having inlet and outlet passages, interior wall means within said housing intermediate said inlet and outlet passages, said interior wall means having an opening for the passage of refrigerant vapor, said interior wall means having means on the inlet passage side of the opening defining a first valve seat and having means on the outlet passage side of the opening defining a second valve seat, said valve housing having first wall means spaced from and overlying said first valve seat, a valve stem mounted for axial movement in said first wall means, means for axially moving said valve stem, a first valve member mounted on said valve stem and positioned to be moved into and out of engagement with said first valve seat, said valve housing having second wall means spaced from and underlying said second valve seat, shaft means mounted on said second wall means, a second valve member slideably mounted on said shaft means and adapted to be moved into and out of engagement with said second valve seat, means urging said second valve member into engagement with said second valve seat, and means for applying fluid pressure to said second valve member to urge it into engagement with said second valve seat, said inlet passage being connectable to the outlet of the evaporator, said outlet passage being connectable to the suction line to the compressor, and said means for applying fluid pressure being connectable to the line between the compressor and condenser.

2. The invention of claim 1, in which said means for applying fluid pressure to said second valve member comprises said shaft means mounted on said second wall means being hollow and communicating at its inner end with the interior of the valve member and at its outer end with a line between the compressor and the condenser.

3. The invention of claim 1, in which the shaft means extends inwardly of said housing, and said means urging said second valve member into engagement with said second valve seat is a spring mounted on said shaft means.

4. The invention of claim 1, in which the shaft means extends inwardly of said housing, said means urging said second valve member into engagement with said second valve seat is a spring mounted on said shaft means, and a spacer mounted on the lower end of said shaft means, said spacer receiving the lower portion of said spring and having means positioned to engage said second valve member to restrict its length of travel away from said second valve seat.

5. The invention of claim 1, and a generally cylindrical vapor strainer mounted between said interior wall means and said second wall means and surrounding said second valve member and said shaft means.

6. The invention of claim 1, in which said second wall means is removable from said valve housing.

7. The invention of claim 1, in which said inlet passage is connected to the outlet of the evaporator and the outlet passage is connected to the suction line to the compressor.

8. The invention of claim 1, in which said inlet passage is connected to the outlet of the evaporator, the outlet passage is connected to the suction line to the compressor, said shaft means is hollow and communicates at its inner end with the interior of the second valve member and at its outer end is connected to the line between the compressor and the condenser, and in which said means urging said second valve member into engagement with said second valve seat is overcome by vapor flow tending to open said second valve member during normal operation but closes said second valve member during shutdown to prevent reverse flow, and in which the fluid pressure applied to the second valve member assists said second valve urging means to hold the valve closed during start-up of the compressor, but permits it to open thereafter during normal running operation, and assists said second valve urging means to hold the second valve closed during shutdown.

* * * * *